US008226016B2

(12) United States Patent
Felton et al.

(10) Patent No.: US 8,226,016 B2
(45) Date of Patent: Jul. 24, 2012

(54) FUEL INJECTOR ASSEMBLY

(75) Inventors: George Nicholas Felton, Gillingham (GB); Leslie Crowder, Rainham (GB)

(73) Assignee: Delphi Technologies Holding S.arl, Troy, MI (US)

( * ) Notice: Subject to any disclaimer, the term of this patent is extended or adjusted under 35 U.S.C. 154(b) by 308 days.

(21) Appl. No.: 12/315,074

(22) Filed: Nov. 26, 2008

(65) Prior Publication Data

US 2009/0166445 A1 Jul. 2, 2009

(30) Foreign Application Priority Data

Dec. 31, 2007 (EP) ..... 07124184

(51) Int. Cl.
*B05B 9/00* (2006.01)

(52) U.S. Cl. ..... 239/124; 239/533.2; 239/600

(58) Field of Classification Search ..... 239/124–127, 239/533.2, 533.11, 600
See application file for complete search history.

(56) References Cited

U.S. PATENT DOCUMENTS

| | | | | |
|---|---|---|---|---|
| 2,613,996 | A * | 10/1952 | Letts | 239/125 |
| 4,790,055 | A | 12/1988 | Raufeisen et al. | |
| 4,826,082 | A * | 5/1989 | Greiner et al. | 239/113 |
| 4,982,902 | A * | 1/1991 | Knapp et al. | 239/585.3 |
| 6,959,878 | B1 | 11/2005 | O'Brien et al. | |
| 2004/0231637 | A1 | 11/2004 | Dick et al. | |

FOREIGN PATENT DOCUMENTS

| | | |
|---|---|---|
| DE | 100 36 137 | 2/2002 |
| GB | 2 332 927 | 7/1999 |
| JP | 64-19169 | 1/1989 |
| JP | 2007-309269 | 11/2007 |
| WO | 03/071123 | 8/2003 |

OTHER PUBLICATIONS

European Search Report dated Apr. 24, 2008.
Japan Office Action dated Dec. 27, 2010.

* cited by examiner

*Primary Examiner* — Christopher Kim
(74) *Attorney, Agent, or Firm* — Mark H. Svoboda

(57) ABSTRACT

A fuel injector assembly comprising an injector body having a leading end, a fuel inlet passage, a backleak passage and a trailing end that terminates in an end surface; a cap that fits over the trailing end of the injector body to define therebetween a chamber for receiving fuel from said backleak passage; and a seal for sealing said chamber to prevent the flow of fuel therefrom, wherein said seal is disposed between said end surface of the trailing end and an inlet end of said fuel inlet passage.

8 Claims, 2 Drawing Sheets

FUEL INJECTOR ASSEMBLY

FIELD OF THE INVENTION

The invention relates to fuel injector assemblies and to engines comprising such fuel injector assemblies.

BACKGROUND TO THE INVENTION

Conventional fuel injectors have an axially extending threaded connection at their trailing end for attachment to a high pressure fuel delivery pipe. The minimum bend radius permitted in this pipe can cause installation problems and limits the height of the assembly.

It is known to provide fuel injectors that have an injector body provided with an entry projecting from the side of the injector body for connection to the high pressure fuel delivery pipe. This arrangement avoids, or at least reduces, the height problem. However, such side entry fuel injectors give rise to problems where an engine top cover is to be installed over the installed injector. Specifically, such covers include an aperture to allow the cover to be installed over the fuel injector and the aperture is fitted with an aperture seal. If such a cover is fitted over an installed side entry injector, the aperture seal may be damaged or destroyed. If the side entry is not perpendicular to the injector body, it may be possible to avoid this problem by removing the seal prior to installing the engine cover and subsequently fitting and adjusting the seal. However, this increases the installation work required and if the angle of the side inlet is made steeper relative to the injector body to make it easier to install the engine cover, the height reduction benefit obtained by having a side entry is reduced.

SUMMARY OF THE INVENTION

According to a first aspect of the present invention, there is provided a fuel injector assembly comprising:

an injector body having a leading end, a fuel inlet passage, a backleak passage and a trailing end that terminates in an end surface;

a cap that fits over the trailing end of the injector body to define therebetween a chamber for receiving fuel from said backleak passage; and a seal for sealing said chamber to prevent the flow of fuel therefrom, wherein said seal is disposed between said end surface of the trailing end and an inlet end of said fuel inlet passage.

Thus, the present invention provides a fuel injector assembly having a backleak chamber that is of simple construction.

Advantageously, said seal comprises an O-ring. Conveniently, said cap comprises a substantially cylindrical body having a groove formed on an inner surface thereof for seating said O-ring. Alternatively, or in addition, said injector body may comprise a groove for seating said O-ring.

Conveniently, the inlet end of the fuel inlet passage is defined in a sidewall of the injector body, and said cap comprises an opening, through which, in use, fuel is supplied to said fuel inlet passage.

Advantageously, the fuel injector assembly comprises an inlet connector having a fuel delivery passage and being securable to said cap such that it extends through said opening and fuel can pass from said fuel delivery passage into said fuel inlet passage.

Conveniently, said cap comprises an outlet that is connectable to a backleak return pipe and in flow communication with said chamber.

In a second aspect of the present invention, an internal combustion engine fitted with a fuel injector assembly according to the first aspect of the present invention is provided. Conveniently, said engine is fitted with a cover and said trailing end of the injector body and said cap are disposed externally of said cover.

According to a third aspect of the present invention, there is provided a fuel injector assembly comprising:

an injector body having a leading end, a fuel inlet passage, a backleak passage and a trailing end that terminates in an end surface;

a cap that fits over the trailing end of the injector body to define therebetween a chamber for receiving fuel from said backleak passage; and a seal for sealing said chamber to prevent the flow of fuel therefrom, wherein said seal is disposed between said end surface of the trailing end and an inlet end of said fuel inlet passage; wherein said seal comprises an O-ring;

wherein the inlet end of the fuel inlet passage is defined in a sidewall of the injector body, and said cap comprises an opening, through which, in use, fuel is supplied to said fuel inlet passage.

According to a fourth aspect of the present invention, there is provided a fuel injector assembly comprising:

an injector body having a leading end, a fuel inlet passage, a backleak passage and a trailing end that terminates in an end surface;

a cap that fits over the trailing end of the injector body to define therebetween a chamber for receiving fuel from said backleak passage; and a seal for sealing said chamber to prevent the flow of fuel therefrom, wherein said seal is disposed between said end surface of the trailing end and an inlet end of said fuel inlet passage, wherein said seal comprises an O-ring; and wherein said cap comprises an outlet that is connectable to a backleak return pipe and in flow communication with said chamber.

Preferred and/or optional features of the first, third and fourth aspects of the invention may be incorporated within the internal combustion engine of the second aspect, alone or in appropriate combination.

BRIEF DESCRIPTION OF THE DRAWINGS

Embodiments of the present invention will now be described, by way of example only, with reference to the accompanying drawings, in which.

DETAILED DESCRIPTION OF THE EMBODIMENTS

Figure 1:
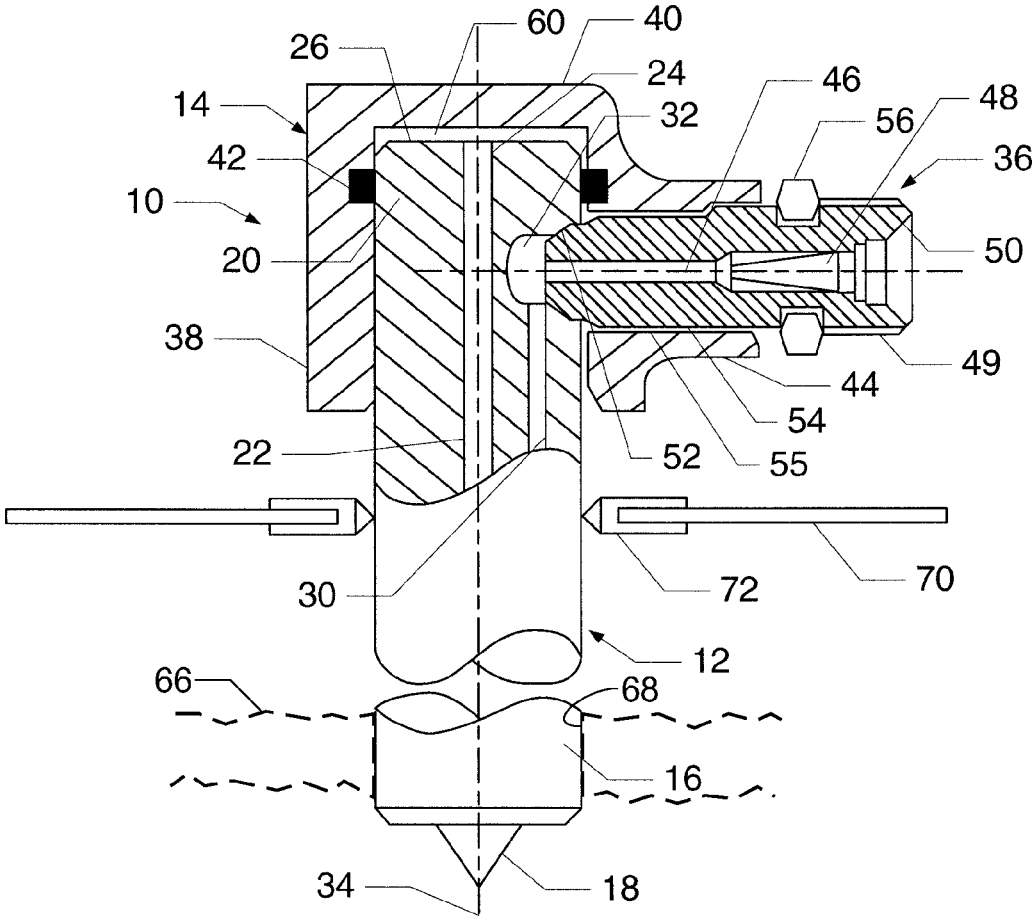
FIG. 1 is a partial cross-sectional view of a fuel injector installed in an engine top cover looking in the direction of the arrows I in FIG. 2.
Figure 2:
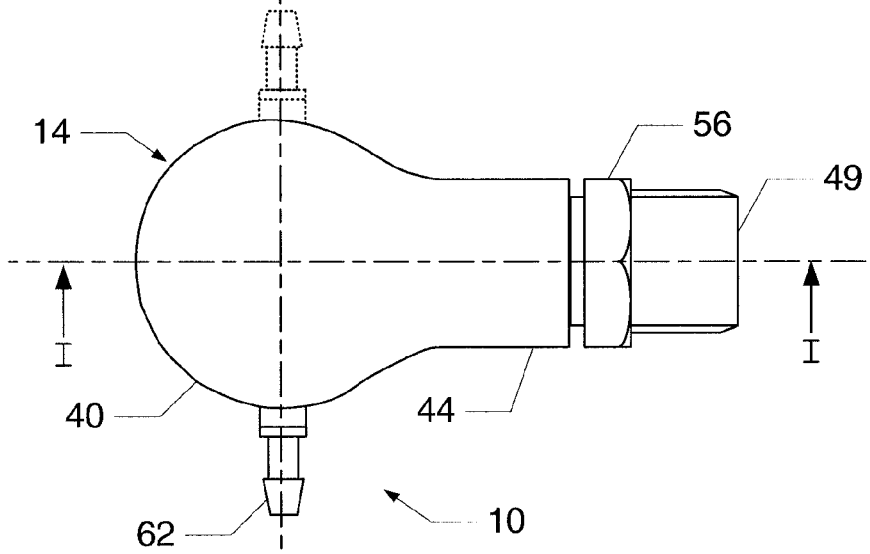
FIG. 2 is a plan view of the fuel injector looking from above as viewed in FIG. 1.

Referring to FIGS. 1 and 2, a fuel injector 10 comprises an injector body 12 and a fitting in the form of a cap 14 that fits onto the injector body. The injector body 12 is essentially a plain cylinder and has a leading end 16 fitted with a nozzle 18 (indicated schematically) and a trailing end 20, on which the cap 14 is fitted. The leading end 16 of the injector body and nozzle components may be of any suitable known type and may include features to assist with fitting and sealing in a port 68 of an engine 66.

The injector body 12 is provided with a backleak passage 22 that extends from an inlet end (not shown) to an outlet end 24 that is located in a transverse end surface 26 of the injector body. The injector body 12 is additionally provided with a fuel inlet passage 30 that extends in the lengthways direction of the injector body parallel to the axis 34 of the injector body. The fuel inlet passage 30 serves to deliver high pressure fuel to the leading end 16 of the injector body for supply to an engine 66 via the nozzle 18. The fuel inlet passage 30 has an inlet end 32 defined by a cross drilling that extends perpendicular to the axis 34 of the injector body 12 through the side of the injector body. The inlet end 32 of the fuel inlet passage includes a conical sealing surface for mating with an inlet connector 36.

The cap 14 is a metal part comprising a generally cylindrical body 38 that is closed at one end by a transverse wall 40 and is sized to be a clearance fit over the trailing end 20 of the injector body 12. The inside of the cylindrical body 38 is provided with a groove, in which an O-ring 42 is seated for sealing against the injector body 12. However, it will be appreciated that the injector body 12 may instead be provided with the groove, in which the O-ring 42 is seated for sealing against the inside of the cylindrical body 38. Alternatively, corresponding grooves could be formed in both the cylindrical body 38 and the injector body 12.

The cap 14 is provided with a generally tubular extension 44 that is formed integrally with the cylindrical body 38 and projects from the body substantially perpendicular to the axis of the body 38. The tubular extension 44 defines an opening in the cap 14, through which fuel is supplied to the inlet end 32 of the fuel inlet passage 30.

The inlet connector 36 is a generally cylindrical body provided with an axially extending fuel delivery passage 46 that is made up of a series of drillings. Those drillings may include one that is sized to receive an edge filter 48. The drilling at the upstream end of the fuel delivery passage 46 provides a conical surface 50 for sealingly engaging a suitably shaped end of a high pressure fuel delivery pipe (not shown). At the same end, the inlet connector 36 is provided with external threading 49, by means of which a union nut can be used to couple the high pressure fuel delivery pipe to the inlet connector 36.

The leading end of the inlet connector 36 has a conical surface 52 that leads into an externally threaded portion 54 that engages an internal threading 55 provided at the inner end of the tubular extension 44 of the cap 14. A hexagonal formation 56 is provided on the inlet connector 36 so that it can be firmly secured to the cap 14 by screwing the threading 54 into the internal threading 55 of the tubular extension 44. The conical surface 52 is shaped to complement the conical sealing surface of the inlet end 32 of the fuel inlet passage 30 so that when the inlet connector 36 is screwed into position in the tubular extension 44, the two surfaces mate to form a seal between the inlet connector 36 and the injector body 12. The engagement between the two conical surfaces additionally fixes the cap 14 to the injector body 12 so that relative movement between the two parts 12, 14 is substantially prevented.

When the cap 14 is secured in place on the free end 20 of the injector body 12, the transverse wall 40 is disposed opposite and spaced apart from the transverse end surface 26 of the injector body 12 to define a backleak vent chamber 60 therebetween, in which fuel from the backleak passage 22 is received. The cap 14 is provided with an outlet connection 62 for connection to a backleak return pipe (not shown). In the embodiment, the outlet connection 62 is a push-fit connector, on which a backleak return pipe can sealingly engage by push-fitting, although alternative connections (such as, for example, a screwed fitting) can be used. The outlet connection 62 is in fluid communication with the backleak vent chamber 60 so that backleak fuel from the chamber 60 can flow into the backleak return pipe for return to a low pressure fuel reservoir.

In use, the injector assembly 10 is fitted to an engine 66 by first fitting the leading end 16 of the injector body 12 (without the cap 14 and inlet connector 36) into an inlet port 68 in the engine cylinder head. An engine top cover 70 is then fitted over the injector body 12 onto a cover seat provided on the engine such that the trailing end 20 of the injector body projects through an aperture provided in the engine top cover (in practice a multi-cylinder engine will have a plurality of injector bodies fitted in respective inlet ports 68 and the engine top cover will have respective apertures for the injectors). The engine top cover 70 is provided with a sealing element 72 around the aperture, which sealingly engages the injector body 12.

Once the engine top cover 70 is secured in place, the cap 14 is fitted onto the trailing end 20 of the injector body 12 bringing the O-ring 42 provided on the cylindrical portion 38 of the cap 14 into engagement with injector body 12. It is preferred that, prior to fitting the cap 14, the tubular extension 44 is at least roughly aligned with the inlet end 32 of the fuel inlet passage 30. The inlet connector 36 is then inserted into the tubular extension 44 of the cap 14 and rotated to bring the threading 54 into engagement with the internal threading 55 of the tubular extension. When the conical surface 52 of the inlet connector 36 starts to engage the conical sealing surface of the inlet end 32 of the fuel inlet passage 30, any misalignment will be corrected automatically and the inlet connector 36 can be screwed firmly into position by means of a spanner applied to the hexagonal formation 56. If the tubular extension 44 is not well aligned with the inlet end 32 of the fuel inlet passage 30 when the leading end of the inlet connector 36 is screwed in, the cap 14 can be rotated relative to the injector body 12 until the conical surface 52 is felt to engage in the conical sealing surface of the inlet end 32. Once the inlet connector 36 is firmly screwed into position, relative movement between the cap 14 and injector body 12 is substantially prevented and the backleak vent chamber 60 is sealed against leakage between the cap 14 and injector body 12 by the O-ring 42.

To complete the fitting process, a high pressure fuel delivery pipe (not shown) is secured to the inlet connector 36 by pressing the end of the pipe into the conical surface 50 and threading a union nut onto the threading 49. Additionally, a backleak pipe (not shown) is push-fitted onto the outlet connection 62.

It will be appreciated that the embodiment provides a side entry fuel injector 10 that can easily be installed to an engine fitted with an engine top cover 70. Since the injector body 12 can be installed separately from the cap 14 and inlet connector 36 and is simply a generally cylindrical body, it is relatively easy to fit the engine top cover 70 over the installed injector body 12 without the risk of damaging or destroying the engine top cover aperture seal 72. The cap 14 and inlet connector 36 can easily be fitted to the injector body 12 once the engine top cover 70 is installed. Thus, the advantages of height reduction available when side entry fuel injectors are used can be readily obtained even when an engine top cover has to be installed over the fuel injectors.

It will further be appreciated that the above-described embodiment provides an injector assembly having a backleak chamber that can be sealed by means of a single O-ring.

Accordingly, the manufacturing cost, assembly time, and associated assembly cost, are minimized.

As mentioned previously, the O-ring 42 is preferably retained in a groove formed on the inside surface of the cylindrical body 38 of the cap 14. Accordingly, during assembly, the O-ring 42 is placed in the groove and the cap 14 is pushed onto the trailing end 20 of the injector body 12. In the case that the groove is formed on the outside surface of the injector body 12, the O-ring 42 is first pressed over the trailing end 20 of the injector body 12 in order to locate it in the groove and, subsequently, the cap 14 is push-fitted in place on the trailing end 20 of the injector body 12. With both of the aforementioned configurations, the fact that the O-ring 42 is disposed between the end surface 26 of the injector body 12 and the inlet end 32 of the fuel inlet passage 30 means that there is no risk of the O-ring 42 being damaged by the edges of the cross drilling at the inlet end 32 of the fuel inlet passage 30 during assembly. Such damage could occur if the O-ring 42 were disposed at a point further along the injector body 12, closer to the nozzle 18, and on the opposite side of the inlet end 32 of the fuel inlet passage 30.

A further advantage of the above-described embodiment is that, by virtue of the fact that the O-ring 42 is disposed between the end surface 26 of the injector body 12 and the inlet end 32 of the fuel inlet passage 30, the high pressure fuel connection between the inlet connector 36 and the injector body 12 is disposed outside of the backleak chamber 60. Accordingly, in the event that the inlet connector 36 is not properly mated with the conical surface at the inlet end 32 of the fuel inlet passage 30, either during assembly or subsequent servicing, any fuel leakage will be visible on the outside of the injector body 12. For example, fuel may leak out from the open end of the cylindrical body 38 of the cap 14. This is convenient since it provides a clear indication that there is a fault with the injector assembly 10. By contrast, if the inlet connector 36 were disposed within the backleak chamber 60, any fuel leakage would flow into the backleak chamber 60 and through the backleak return pipe to the low pressure fuel reservoir. This would mean that any fault may go unrecognized. Thus, in the event of a fault, the injector assembly of the described embodiment increases the chances of the fault being diagnosed.

It will be appreciated that the backleak vent chamber 60 does not have to be provided between the transverse end surface 26 of the injector body 12 and the transverse wall 40 of the cap 14. Instead, a fitting could be provided with a suitably positioned recess such that the backleak vent chamber is defined between the fitting and a sidewall of the injector body 12.

It will be appreciated that the position of the outlet connection of the cap 14 or fitting can be selected to accord with a particular engine, to which it is to be installed so as to provide optimum routing of the backleak return. One alternative position for the outlet connection is indicated by dashed lines in FIG. 2. Alternatively, the cap 14 may be provided with two outlet connections 62 in order to facilitate the connection of the backleak chambers of each of a plurality of injectors of the engine in series.

Figure 3:
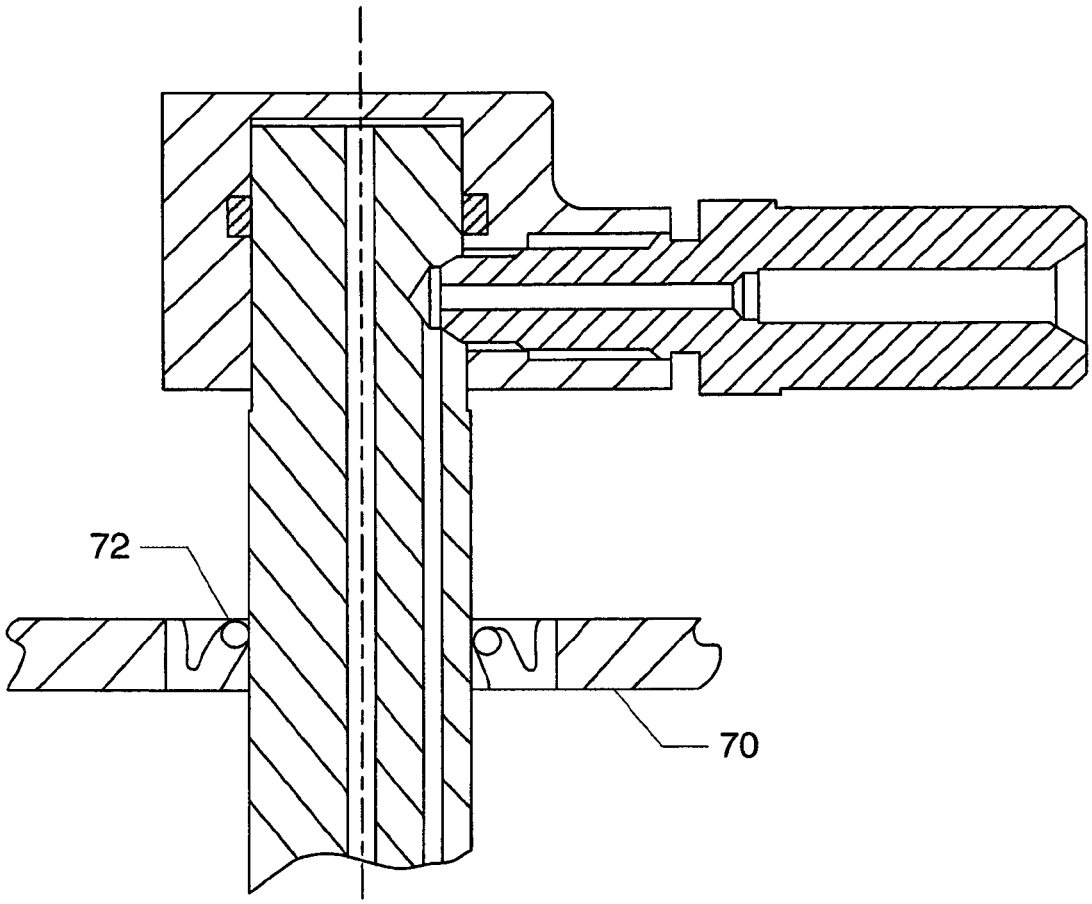
FIG. 3 is a partial cross-sectional view of a fuel injector installed in an engine top cover looking in the direction of the arrows I in FIG. 4.
Figure 4:
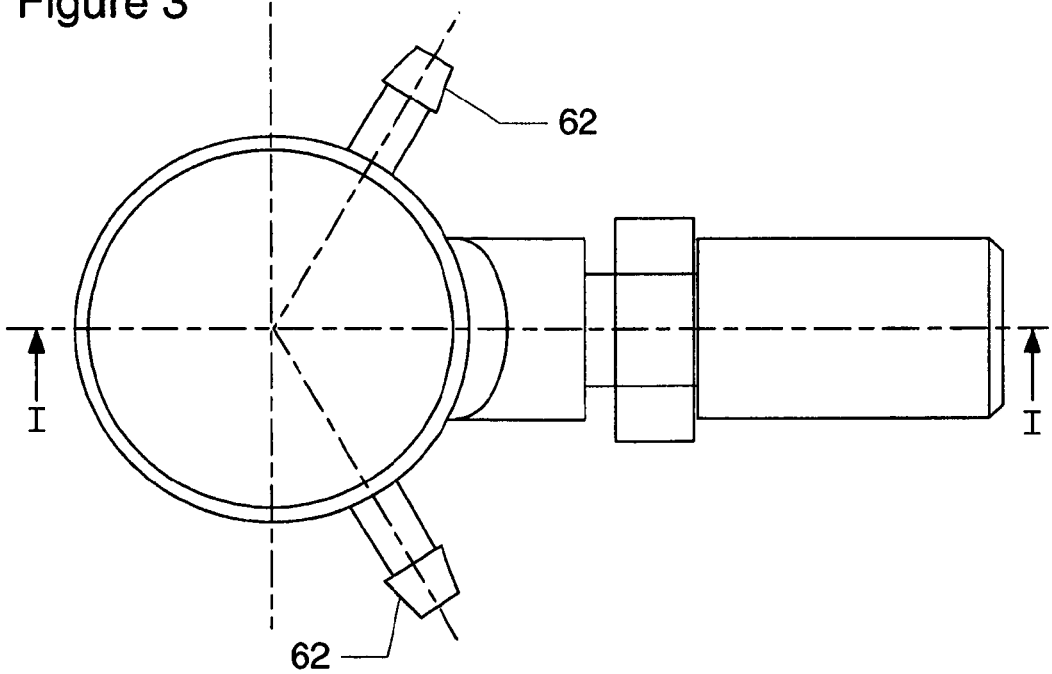
FIG. 4 is a plan view of the fuel injector looking from above as viewed in FIG. 3.

FIG. 3 shows an alternative configuration of the engine top cover aperture seal 72. FIG. 4 shows alternative positions of the outlet connections 62.

It is envisaged that the cap 14 or fitting will be made of a suitable metal, for example steel. However, it might also be made of a non-metallic material that has the required properties such as ceramics or suitable engineering plastics.

The invention claimed is:

1. A fuel injector assembly comprising:

a substantially cylindrical injector body having a longitudinal axis and having a leading end, a fuel inlet passage, a backleak passage, and a trailing end that terminates in an end surface;

a cap that is sized to be a clearance fit over the trailing end of the injector body, said cap fitted over the trailing end of the injector body to define, therebetween, a chamber for receiving fuel from said backleak passage; and a seal for sealing said chamber so as to prevent the flow of fuel therefrom, wherein said seal is axially located between said end surface of the trailing end and an inlet end of said fuel inlet passage;

wherein the inlet end of the fuel inlet passage is defined in a sidewall of the injector body, and said cap defines an opening through which, in use, fuel is supplied to the inlet end of said fuel inlet passage;

wherein the injector body and cap are configured to receive a threaded inlet connector having a fuel delivery passage, the cap defining an opening configured to receive the inlet connector therethrough, the cap additionally defining threads configured to cooperate with the threads on the inlet connector to secure the inlet connector to the cap so as to urge the inlet connector into fluidtight engagement with the inlet end of the fuel inlet passage with sufficient force to fix the cap to the injector body so that relative movement between the cap and the injector body is substantially prevented, further comprising the inlet connector; wherein the inlet connector passes through the opening in the cap and engages the injector body fluidtightly, wherein the inlet connector fixes the cap to the injector body to substantially prevent relative movement between the cap and the injector body.

2. A fuel injector assembly according to claim 1, wherein said cap comprises an outlet that is connectable to a backleak return pipe and that is in flow communication with said chamber.

3. An internal combustion engine fitted with a fuel injector assembly according to claim 1, wherein the leading end of the injector is mounted to a port of the engine.

4. An internal combustion engine as claimed in claim 3, wherein said engine is fitted with a cover; wherein said cover defines an opening through which the injector body extends; and wherein said trailing end of the injector body and said cap are disposed externally of said cover.

5. A fuel injector assembly according to claim 1, wherein said seal comprises an O-ring.

6. A fuel injector assembly according to claim 5, wherein said cap comprises a substantially cylindrical body having a groove formed on an inner surface thereof for seating said O-ring.

7. A fuel injector assembly according to claim 5, wherein said injector body comprises a groove for seating said O-ring.

8. A fuel injector assembly comprising:

a substantially cylindrical injector body having a longitudinal axis and having a leading end, a fuel inlet passage, a backleak passage, and a trailing end that terminates in an end surface;

a cap that is sized to be a clearance fit over the trailing end of the injector body, said cap fitted over the trailing end of the injector body to define, therebetween, a chamber for receiving fuel from said backleak passage; and a seal for sealing said chamber so as to prevent the flow of fuel therefrom, wherein said seal is axially located between said end surface of the trailing end and an inlet end of said fuel inlet passage;

wherein the inlet end of the fuel inlet passage is defined in a sidewall of the injector body, and said cap defines an opening through which, in use, fuel is supplied to the inlet end of said fuel inlet passage;

wherein the injector body and cap are configured to receive a threaded inlet connector having a fuel delivery passage, the cap defining an opening configured to receive the inlet connector therethrough, the cap additionally defining threads configured to cooperate with the threads on the inlet connector to secure the inlet connector to the cap so as to urge the inlet connector into fluidtight engagement with the inlet end of the fuel inlet passage with sufficient force to fix the cap to the injector body so that relative movement between the cap and the injector body is substantially prevented, wherein the injector body defines a conical sealing surface around the periphery of the inlet end of the fuel inlet passage, further comprising the inlet connector, wherein the inlet connector passes through the opening in the cap and engages the injector body fluidtightly, wherein the inlet connector fixes the cap to the injector body to substantially prevent relative movement between the cap and the injector body, wherein the inlet connector defines a conical surface shaped to complement the conical sealing surface around the periphery of the inlet end of the fuel inlet passage.

* * * * *